US009068770B2

(12) United States Patent
Lee et al.

(10) Patent No.: US 9,068,770 B2
(45) Date of Patent: Jun. 30, 2015

(54) METHOD FOR CONTROLLING REFRIGERATOR

(71) Applicant: LG Electronics Inc., Seoul (KR)

(72) Inventors: Donghoon Lee, Seoul (KR); Wookyong Lee, Seoul (KR); Juhyun Son, Seoul (KR); Donghoon Lee, Seoul (KR); Dongjeong Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 216 days.

(21) Appl. No.: 13/915,714

(22) Filed: Jun. 12, 2013

(65) Prior Publication Data

US 2013/0327068 A1 Dec. 12, 2013

(30) Foreign Application Priority Data

Jun. 12, 2012 (KR) ..... 10-2012-0062506

(51) Int. Cl.
*F25C 1/00* (2006.01)
*F25C 1/22* (2006.01)

(52) U.S. Cl.
CPC . *F25C 1/00* (2013.01); *F25C 1/225* (2013.01); *F25C 2600/04* (2013.01); *F25C 2700/04* (2013.01)

(58) Field of Classification Search
CPC ..... F25C 1/00; F25C 1/225; F25C 2700/04; F25C 2600/04
USPC ..... 62/66, 74, 126, 135, 157, 340, 348
See application file for complete search history.

(56) References Cited

U.S. PATENT DOCUMENTS

| | | | | |
|---|---|---|---|---|
| 2004/0107721 | A1* | 6/2004 | Choi et al. | 62/340 |
| 2005/0155360 | A1* | 7/2005 | Yoshida et al. | 62/135 |
| 2005/0178273 | A1* | 8/2005 | Meuleners et al. | 99/279 |
| 2005/0268624 | A1* | 12/2005 | Voglewede et al. | 62/126 |
| 2007/0175919 | A1* | 8/2007 | Hortin et al. | 222/64 |
| 2008/0016900 | A1* | 1/2008 | Bippus et al. | 62/348 |
| 2008/0041073 | A1* | 2/2008 | Ferragut et al. | 62/129 |
| 2009/0025826 | A1* | 1/2009 | Meuleners et al. | 141/351 |
| 2009/0173085 | A1* | 7/2009 | Broadbent et al. | 62/66 |
| 2010/0326096 | A1* | 12/2010 | Junge et al. | 62/82 |
| 2011/0036103 | A1* | 2/2011 | Bippus et al. | 62/74 |

* cited by examiner

*Primary Examiner* — Mohammad M Ali
(74) *Attorney, Agent, or Firm* — Fish & Richardson P.C.

(57) ABSTRACT

A method for controlling a refrigerator includes starting water supply to an ice making device in a refrigerator. The ice making device includes a flow sensor configured to detect water supply flow to the ice making device by using a pulse value according to rotation of an impeller. The method also includes operating the flow sensor to detect a pulse value, determining whether the pulse value has reached a target pulse value within a preset time, and, based on a determination that the detected pulse value has not reached the target pulse value within the preset time, determining that water supply to the ice making device is in a low water-pressure state and performing a water supply control process according to the low water-pressure state.

20 Claims, 4 Drawing Sheets

METHOD FOR CONTROLLING REFRIGERATOR

CROSS-REFERENCE TO RELATED APPLICATIONS

The present application claims the benefit of priority to Korean Patent Application No. 10-2012-0062506 filed on Jun. 12, 2012, which is herein incorporated by reference in its entirety.

FIELD

The present disclosure relates to a method for controlling a refrigerator.

BACKGROUND

Refrigerators are home appliances that store foods in a refrigerated or frozen state. An ice making device for making ice is commonly mounted to such a refrigerator. When the ice making device is included in a refrigerator, a water supply mechanism for making ice is provided. Here, an important factor is accurately controlling an amount of water to be supplied for making ice. In particular, in an ice making device for making globular or spherical ice pieces, an amount of supplied water should be accurately controlled. For example, if the amount of supplied water is insufficient, the ice pieces will not be globular or spherical. On the other hand, if an amount of supplied water is excessive, an ice making tray may be broken due to the volume expansion of ice during the ice making process.

FIG. 1 illustrates an example prior art water supply system for making ice in a refrigerator.

Referring to FIG. 1, a water supply passage is connected to a water supply source 1, and a switching valve 2 is mounted on the water supply passage. A flow sensor 3 is mounted on an outlet side of the switching valve 2, and the water supply passage has an end connected to a water supply hole of an ice maker 5. The flow sensor 3 and the valve 2 are electrically controllably connected to a controller 4 (e.g., a Micom).

In some examples, a flowmeter may be used as the flow sensor 3, and an amount of water to be supplied may be calculated according to the number of pulses of the flowmeter corresponding to the rotation number of the flowmeter. When the water is completely supplied, a valve locking signal may be output from the controller 4 to close the valve 2.

A method of supplying water for a time preset in the controller 4 is another method of supplying water into the ice maker. For example, if a water supply time is set to about five seconds, water may be unconditionally supplied for about five seconds regardless of a water-pressure of a water supply source.

In the case of time control, since it is impossible to consider a water supply deviation due to the pressure, an amount of water supplied into an ice making tray may be significantly different depending on the pressure of water to be supplied.

In the case of flow sensor control, when the flow sensor is used in a low water-pressure area, water may be excessively supplied more than a target amount. This may occur because an impeller of the flow sensor may not operate due to the low water pressure, and thus water may pass around the impeller to increase an amount of supplied water to the detected pulse value.

FIG. 2 illustrates an excessive water supply phenomenon occurring when water supply is controlled using the flow sensor in the low water-pressure area.

As shown in FIG. 2, more than the target amount A of water is supplied in the low water-pressure area.

SUMMARY

In one aspect, a method includes starting water supply to an ice making device in a refrigerator. The ice making device includes a flow sensor configured to detect water supply flow to the ice making device by using a pulse value according to rotation of an impeller. The method also includes, after starting the water supply, operating the flow sensor to detect a pulse value, accessing a target pulse value, comparing the detected pulse value to the target pulse value, and, based on comparison results, determining whether the detected pulse value has reached the target pulse value within a preset time. The method further includes, based on a determination that the detected pulse value has not reached the target pulse value within the preset time, determining that water supply to the ice making device is in a low water-pressure state and performing a water supply control process according to the low water-pressure state. The water supply control process according to the low water-pressure state includes calculating a measurement of water supplied to the ice making device based on the detected pulse value for the preset time, determining a measurement of additional water needed to reach a target, setting a new target pulse value corresponding to the measurement of additional water needed to reach the target, and supplying additional water to the ice making device until the new target pulse value has been reached.

Implementations may include one or more of the following features. For example, the method may include stopping water supply to the ice making device based on the detected pulse value reaching the target pulse value within the preset time. The measurement of water supplied to the ice making device, the measurement of additional water, and the new target pulse value may be stored in a lookup table.

In some implementations, the measurement of water supplied to the ice making device may include a flow rate of water supplied to the ice making device and the measurement of additional water may include a flow rate of additional water needed to reach the target. In these implementations, the method may include calculating the flow rate of water supplied to the ice making device using a linear function formula: $y2=Ky1+R$ (K, R: constant, y1: pulse value, y2: flow rate).

In addition, the method may include, based on a determination that water supply to the ice making device is in a low water-pressure state, stopping water supply to the ice making device until the new target pulse value is set. Further, the ice making device may be an ice maker configured to make spherical ice.

In another aspect, a refrigerator includes an ice making device, a flow sensor configured to detect water supply flow to the ice making device by using a pulse value according to rotation of an impeller, and a controller configured to perform operations. The operations include starting water supply to the ice making device and, after starting the water supply, operating the flow sensor to detect a pulse value. The operations also include accessing a target pulse value, comparing the detected pulse value to the target pulse value, and, based on comparison results, determining whether the detected pulse value has reached the target pulse value within a preset time. The operations further include, based on a determination that the detected pulse value has not reached the target pulse value within the preset time, determining that water supply to the ice making device is in a low water-pressure state and performing a water supply control process according to the low water-pressure state. The water supply control process according to the low water-pressure state includes calculating a measurement of water supplied to the ice making device based on the detected pulse value for the preset time, determining a measurement of additional water needed to reach a target, setting a new target pulse value corresponding to the measurement of additional water needed to reach the target, and supplying additional water to the ice making device until the new target pulse value has been reached.

Implementations may include one or more of the following features. For example, the operations may include stopping water supply to the ice making device based on the detected pulse value reaching the target pulse value within the preset time. The measurement of water supplied to the ice making device, the measurement of additional water, and the new target pulse value may be stored in a lookup table.

In some implementations, the measurement of water supplied to the ice making device may include a flow rate of water supplied to the ice making device and the measurement of additional water may include a flow rate of additional water needed to reach the target. In these implementations, the operations may include calculating the flow rate of water supplied to the ice making device using a linear function formula: $y2=Ky1+R$ (K, R: constant, y1: pulse value, y2: flow rate).

In addition, the operations may include, based on a determination that water supply to the ice making device is in a low water-pressure state, stopping water supply to the ice making device until the new target pulse value is set. Further, the ice making device may be an ice maker configured to make spherical ice.

In yet another aspect, a method includes starting water supply to an ice making device in a refrigerator. The ice making device includes a flow sensor configured to detect water supply flow to the ice making device by using a pulse value according to rotation of an impeller. The method also includes, after starting the water supply, operating the flow sensor to detect a pulse value, accessing a target pulse value, comparing the detected pulse value to the target pulse value, and, based on comparison results, determining whether the detected pulse value has reached the target pulse value within a preset time. The method further includes, in response to a determination that the detected pulse value has not reached the target pulse value within the preset time, setting a new target pulse value based on the detected pulse value and supplying additional water to the ice making device until the new target pulse value has been reached.

Implementations may include one or more of the following features. For example, the method may include stopping water supply to the ice making device based on the detected pulse value reaching the target pulse value within the preset time.

In some implementations, the new target pulse value may be stored in a lookup table. In these implementations, the method may include accessing the new target pulse value from the lookup table based on the detected pulse value.

In addition, the method may include, in response to a determination that the detected pulse value has not reached the target pulse value within the preset time, stopping water supply to the ice making device until the new target pulse value is set. The ice making device may be an ice maker configured to make spherical ice.

The details of one or more implementations are set forth in the accompanying drawings and the description below. Other features will be apparent from the description and drawings, and from the claims.

DETAILED DESCRIPTION

Figure 1:
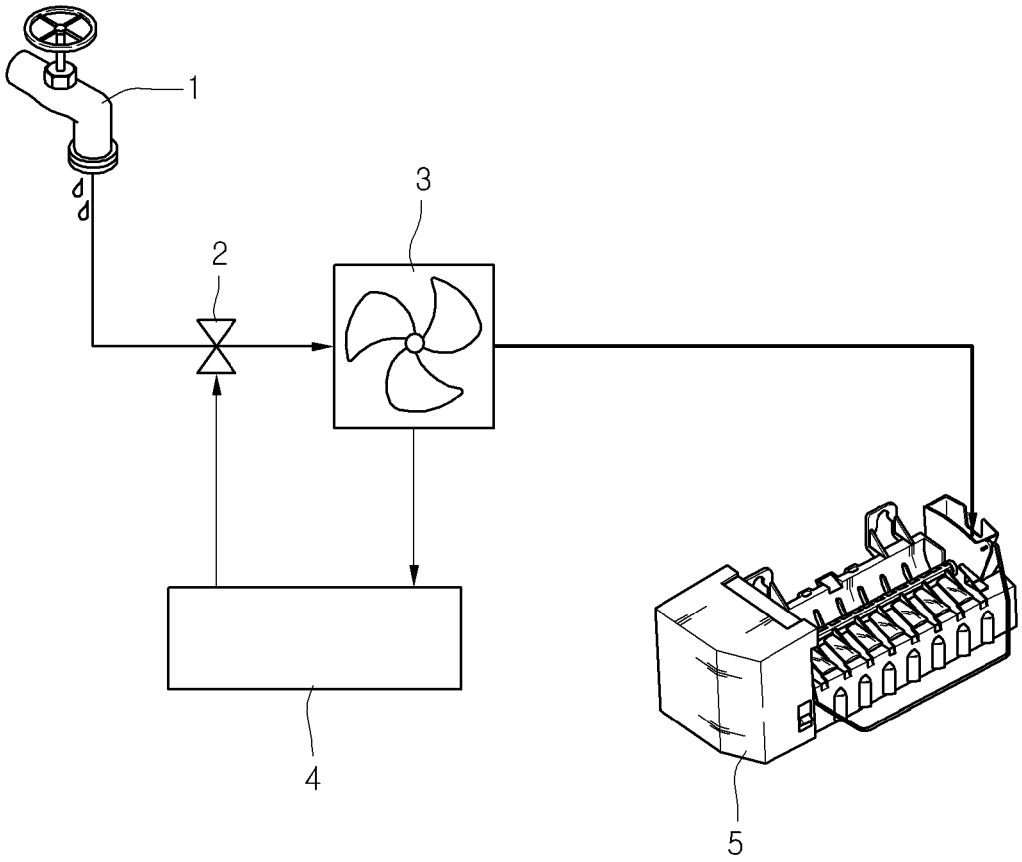
FIG. 1 is a schematic view of an example prior art water supply system for making ice in a refrigerator.
Figure 2:
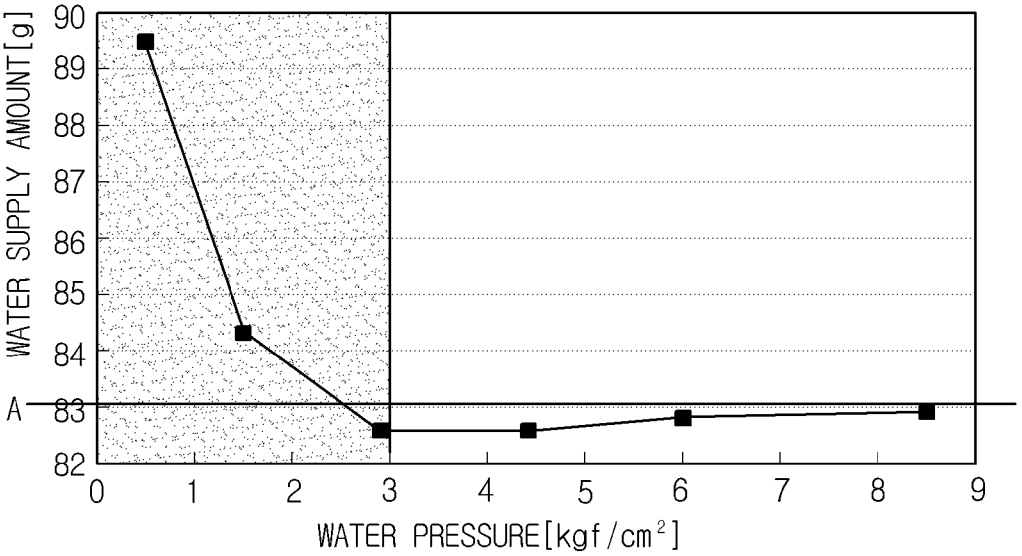
FIG. 2 is a graph illustrating an excessive water supply phenomenon that occurs when water supply is controlled using a flow sensor in a low water-pressure area.
Figure 3:
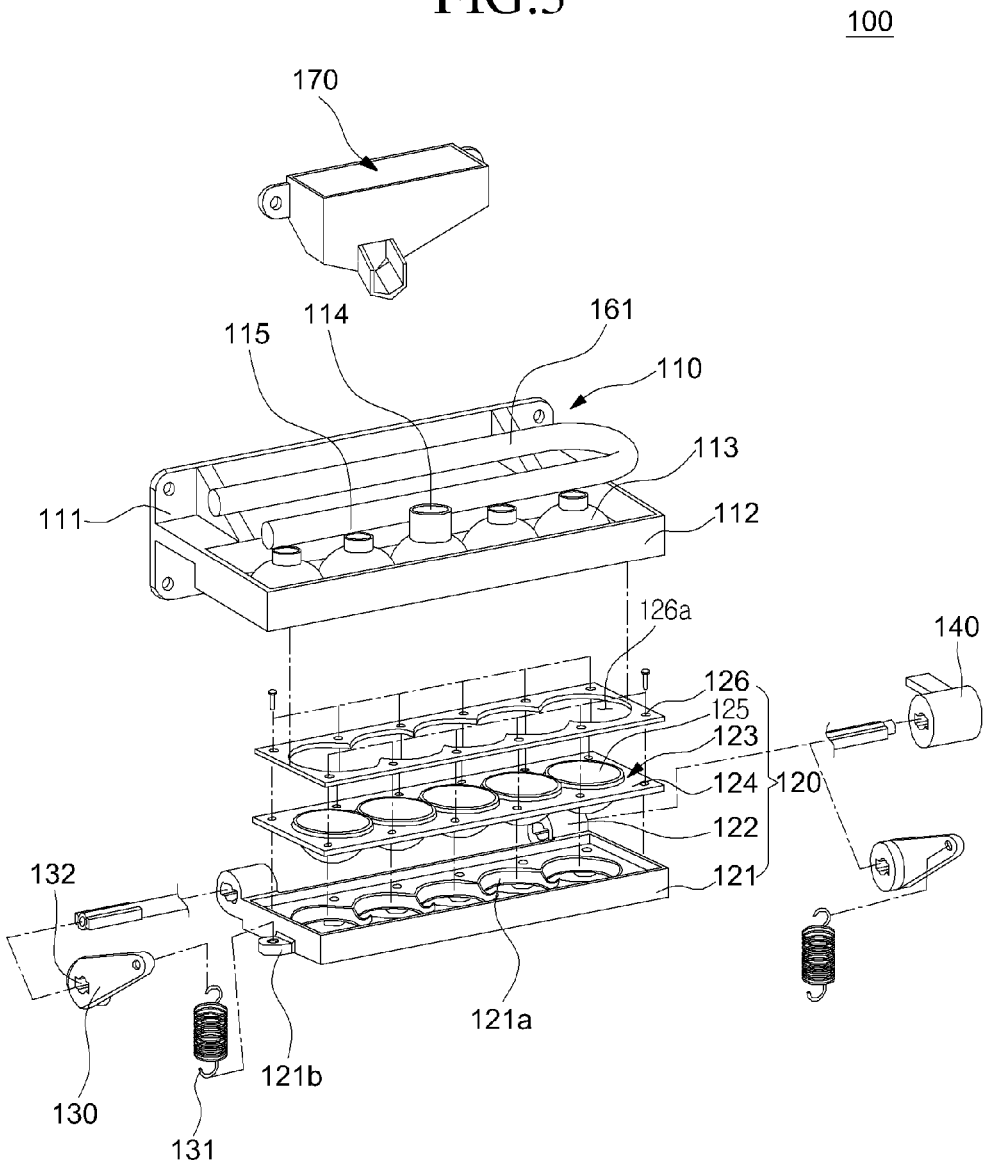
FIG. 3 is a schematic exploded perspective view illustrating an example ice making device to which an example water supply system is applied.
Figure 4:
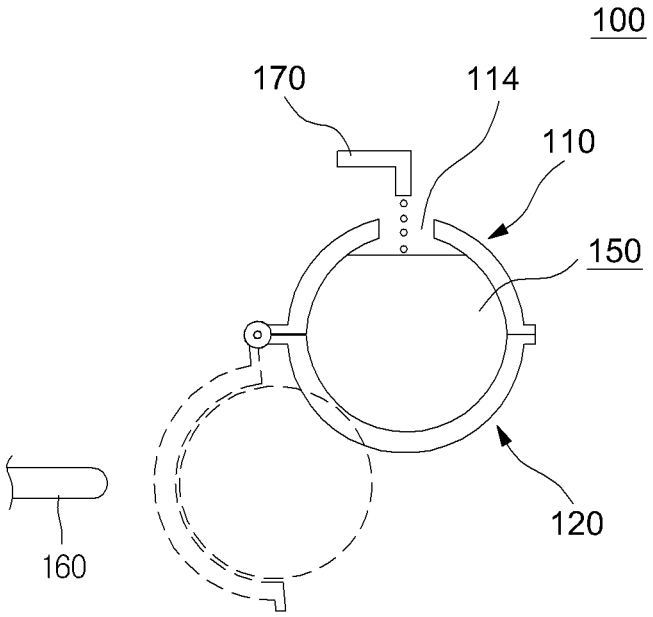
FIG. 4 is a side cross-sectional view illustrating an example water supply state of the ice making device shown in FIG. 3.

FIG. 3 illustrates an example ice making device to which an example water supply system is applied, and FIG. 4 illustrates an example water supply state of the example ice making device.

The control method described throughout this disclosure may be useful when applied to an ice making device for making globular or spherical ice. Thus, an ice making device for making globular or spherical ice will be described below as an example.

Referring to FIGS. 3 and 4, an ice making device 100 includes an upper plate tray 110 defining an upper appearance, a lower plate tray 120 defining a lower appearance, a driving unit 140 for operating one of the upper plate tray 110 and the lower plate tray 120, and an ejecting unit 160 (see FIG. 4) for separating ice pieces made in the upper plate tray 110 or the lower plate tray 120. The ejecting unit 160 includes an ejecting pin having a rod shape.

In some examples, recess parts 125 each having a hemispherical shape may be arranged inside of the lower plate tray 120. Here, each of the recess parts 125 defines a lower half of a globular or spherical ice piece. The lower plate tray 120 may be formed of a metal material. As necessary, at least a portion of the lower plate tray 120 may be formed of an elastically deformable material. For instance, the lower plate tray 120 of which a portion is formed of an elastic material is described as an example.

The lower plate tray 120 includes a tray case 121 defining an outer appearance, a tray body 123 mounted on the tray case 121 and having the recess parts 125, and a tray cover 126 fixing the tray body 123 to the tray case 121.

The tray case 121 may have a square frame shape. Also, the tray case 121 may further extend upward and downward along a circumference thereof. Further, a seat part 121*a* through which the recess parts 125 pass may be disposed inside the tray case 121. In addition, a lower plate tray connection part 122 may be disposed on a rear side of the tray case 121. The lower plate tray connection part 122 may be coupled to the upper plate tray 110 and the driving unit 140. The lower plate tray connection part 122 may function as a center of rotation of the tray case 121. In some implementations, an elastic member mounting part 121*b* may be disposed on a side surface of the tray case 121, and an elastic member 131 providing elastic force so that the lower plate tray 120 is maintained in a closed state may be connected to the elastic member mounting part 121*b*.

The tray body 123 may be formed of an elastically deformable flexible material. The tray body 123 may be seated from an upper side of the tray case 121. The tray body 123 includes a plane part 124 and the recess part 125 recessed from the plane part 124. The recess part 125 may pass through the seat part 121*a* of the tray case 121 to protrude downward. Thus, as shown as a dotted line in FIG. 4, the recess part 125 may be pushed by the ejecting unit 160 when the lower plate tray 120 is rotated to separate the ice within the recess part 125 to the outside.

The tray cover 126 may be disposed above the tray body 123 to fix the tray body 123 to the tray case 121. A punched part 126*a* having a shape corresponding to that of an opened top surface of the recess part 125 defined in the tray body 123 may be defined in the tray cover 126. The punched part 126*a* may have a shape in which a plurality of circular shapes successively overlap one another. Thus, when the lower plate tray 120 is assembled, the recess part 125 is exposed through the punched part 126*a*.

Also, the upper plate tray 110 defines an upper appearance of the ice making device 100. The upper plate tray 110 may include a mounting part 111 for mounting the ice making device 100 and a tray part 112 for making ice.

For instance, the mounting part 111 fixes the ice making device 100 to the inside of a freezing compartment or an ice making chamber. The mounting part 111 may extend in a direction perpendicular to that of the tray part 112. Thus, the mounting part 111 may be stably fixed to a side surface of the freezing compartment or the ice making chamber through surface contact. Also, the tray part 112 may have a shape corresponding to that of the lower plate tray 120. The tray part 112 may include a plurality of recess parts 113 each being recessed upward in a hemispherical shape. The plurality of recess parts 113 are successively arranged in a line. When the upper plate tray 110 and the lower plate tray 120 are closed, the recess part 125 of the lower plate tray 120 and the recess part 113 of the upper plate tray 110 are coupled to match each other in shape, thereby defining a cell 150 which provides an ice making space having a globular or spherical shape. The recess part 113 of the upper plate tray 110 may have a hemispherical shape corresponding to that of the lower plate tray 120.

The upper plate tray 110 may be formed of a metal material entirely. Also, the upper plate tray 110 may be configured to quickly freeze water within the cell 150. In addition, a heater 161 heating the upper plate tray 110 to separate ice may be disposed on the upper plate tray 110. Further, a water supply unit 170 for supplying water into water supply part 114 of the upper plate tray 110 may be disposed above the upper plate tray 110.

The recess part 113 of the upper plate tray 110 may be formed of an elastic material, like the recess part 125 of the lower plate tray 120, so that ice easily separates from the recess part 113.

A rotating arm 130 and the elastic member 131 are disposed on a side of the lower plate tray 120. The rotating arm 130 may be rotatably mounted on the lower plate tray 120 to provide the tension of the elastic member 131.

Also, the rotating arm 130 may have an end 132 axially coupled to the lower plate tray connection part 122. Further, the rotating arm may rotate even though the lower plate tray 120 is closed to allow the elastic member 131 to extend. The elastic member 131 is mounted between the rotating arm 130 and the elastic member mounting part 121*b*. The elastic member 131 may include a tension spring. That is to say, the rotating arm 130 may further rotate in a direction in which the lower plate tray 120 is closely attached to the upper plate tray 110 in the state where the lower plate tray 120 is in the closed state, to allow the elastic member 131 to extend. In a state where the rotating arm 130 is stopped, restoring force is applied to the elastic member 130 in a direction in which the elastic member 130 decreases to an original length thereof. Since the lower plate tray 120 is closely attached to the upper plate tray 110 due to the restoring force, the leakage of water may be reduced (e.g., prevented) during ice making.

In some implementations, a plurality of air holes 115 are defined in the recess parts 113 of the upper plate tray 110. Each of the air holes 115 may be configured to exhaust air when water is supplied into the cell 150. Also, the air hole 115 may have a cylinder sleeve shape extending upward to guide access of an ejecting pin 160 for separating an ice. Here, the ejecting unit 160 may be provided as a structure that does not press the recess part 125 of the lower plate tray 120 in a horizontal state, but that is vertically disposed above the upper plate tray 110 to pass through the air hole 115 and a water supply part 114. And, the ejecting unit 160 may be connected to the rotating arm 130 to ascend or descend when the rotating arm 130 rotates. Therefore, if the lower plate tray 120 rotates, the rotating arm 130 may rotate downward. Thus, the ejecting unit 160 passes through the air hole 115 and the water supply part 114 while descending to push a globular or spherical ice piece attached to the recess part 113 of the upper plate tray 110 out.

The water supply part 114 is disposed in an approximately central portion of the plurality of cells 150. The water supply part 114 may have a diameter greater than that of the air hole 115 to supply water smoothly. The water supply part 114 may be disposed in one end of both left and right ends of the plurality of cells 150 to conveniently supply water. The water supply part 114 may be configured to guide the access of the ejecting unit 160 for exhausting air and separating ice when water is supplied in addition to the water supply function.

As shown in FIG. 4, the upper plate tray 110 and the lower plate tray 120 are closely attached to each other to prevent the stored water from leaking. Also, inner surfaces of the upper plate tray 110 and the lower plate tray 120 may define a globular or spherical surface to make a globular or spherical ice. Whether a perfect globular or spherical ice piece is made may be determined according to an amount of water supplied to the cell 150. For example, if an amount of water supplied to the cell 150 is less than a preset supply amount, a top surface of the ice piece may be flat. On the other hand, if an amount of water supplied to the cell 150 is greater than the present supply amount, the upper plate tray 110 and the lower plate tray 120 may have a gap there between or be broken by the volume expansion of an ice piece during the ice making process. Therefore, the accurate control of a water supply amount in the ice making device for making globular or spherical ice may be an important factor.

Hereinafter, a method for accurately controlling an amount of water to be supplied will be described. An ice making system in which a flowmeter generating a pulse according to a rotation of an impeller may be applied as a unit for detecting an amount of supplied water.

Figure 5:
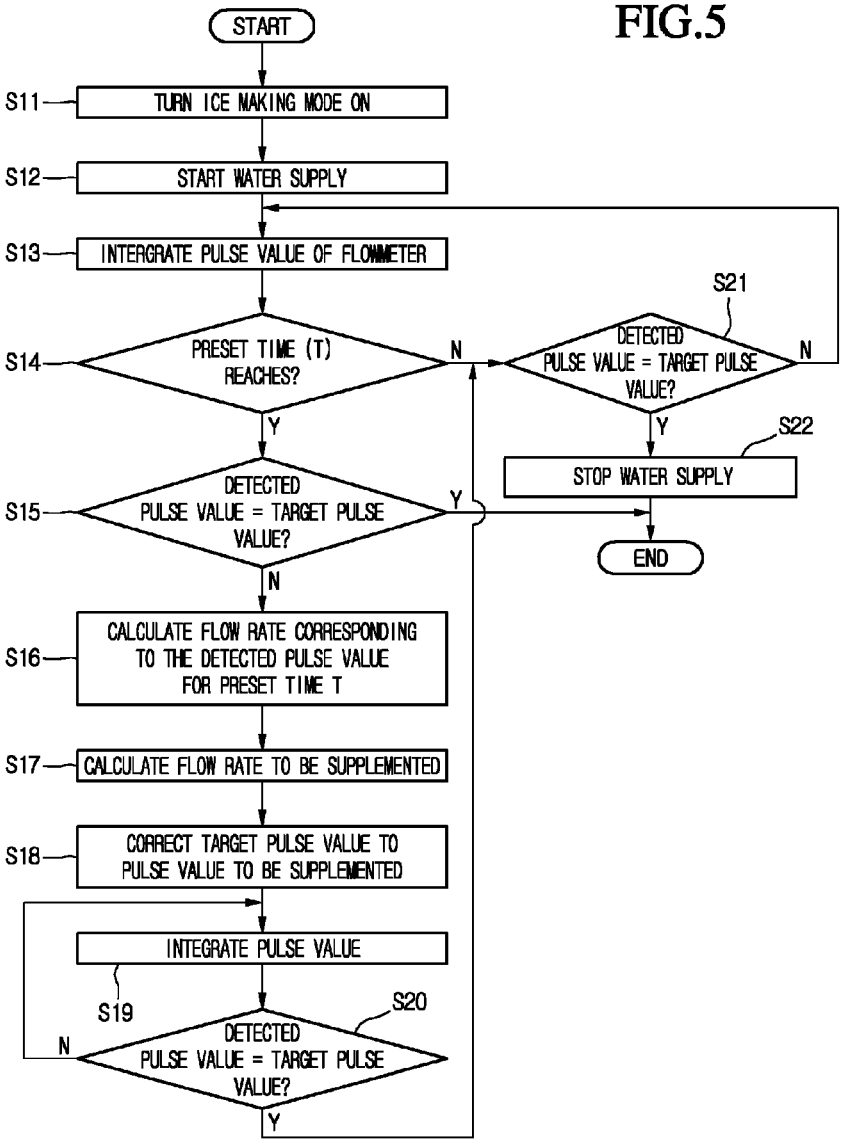
FIG. 5 is a flowchart illustrating an example process for controlling water supply to an ice making device for making globular or spherical ice.

FIG. 5 illustrates an example process for controlling water supply to an ice making device for making globular or spherical ice.

Referring to FIG. 5, first, when an ice making mode is turned on (S11), water is supplied (S12). An impeller of a flowmeter rotates by a pressure of the supplied water to generate pulses according to the rotation of the impeller. A control part including a Micom integrates the pulses generated according to the rotation of the impeller (S13). At the same time, a timer connected to the control part may determine whether a water supply time reaches a preset time T (S14).

As shown, it is determined whether a pulse value reaches a target pulse value before the water supply time reaches the preset time T (S21). If it is determined that the pulse value reaches the target pulse value, the water supply is stopped (S22), and simultaneously, a water supply process is ended.

That is, the water supply is performed in a normal manner due to a sufficiently high water-pressure of a water supply source for a refrigerator. If the pulse value does not reach the target pulse value before the water supply time reaches the preset time T, the control part continuously detects and integrates elapsed times and the pulse values.

Then, the control part determines whether a pulse value detected again reaches the target pulse value at the moment the present time T is reached (S15). If it is determined that the pulse value reaches the target pulse value, the water supply is stopped (S22). On the other hand, if the detected pulse value does not reach the target pulse value even though the water supply time reaches the preset time, it is determined that the water pressure is low, and thus the control part calculates a flow rate of supplied water corresponding to the detected pulse value (S16). Here, the flow rate of supplied water corresponding to the detected pulse value may be obtained from a Table and a Formula, which are calculated through experiments.

After calculating the flow rate of supplied water, a flow rate of water to be additionally supplemented may be calculated (S17). Also, a pulse value corresponding to the flow rate of water to be supplemented is calculated, and the calculated pulse value is corrected as a new target pulse value (S18). Then, the detected pulse value is integrated (S19). When the integrated pulse value reaches the new target pulse value (S20), the water supply is stopped.

The pulse value of the flowmeter and the flow rate of supplied water which are detected for the preset time may be substantially different depending on the water pressure. When the water pressure is equal to or greater than a predetermined pressure, the supplied water flow rate corresponding to a unit pulse value is the same. However, if the water pressure is less than a critical water pressure, the supplied water flow rate per unit pulse may vary.

According to results that are confirmed through experiments under a low water pressure, a linear functional formula may be obtained through the pulse value and the flow rate by using water-pressure as variables. That is, the pulse value detected for the preset time is almost proportional to the water-pressure, and also, the flow rate of supplied water is almost proportional to the water-pressure.

For example, the functional formula is as follows.

$$y1=ax+b(y1\text{: pulse value},x\text{: pressure},a\text{: constant},b\text{: constant})$$

$$y2=cx+d(y2\text{: flow rate of supplied water},x\text{: pressure},c\text{: constant},d\text{: constant})$$

Here, when y1 and y2 are combined with each other, consequentially, it is confirmed that the pulse is a function of a flow rate of supplied water as follows.

$$y2=Ky1+R(K,R\text{: constant})$$

That is, since the water-pressure of the water supply source does not function as a variable, the flow rate of supplied water may be confirmed from the pulse value even if the water-pressure is not confirmed.

Here, the constant values are set as functions to approximate data obtained from the experiments. That is, the constant values may be obtained by the experiments.

As described above, the linear function for the flow rate using the pulse value as a variable is input to the control part. In the state of the low water-pressure that is less than a specific pressure, the flow rates of supplied water and of water to be supplemented may be calculated on the basis of the functional value.

Accordingly, if the pulse value does not reach the target pulse value for the preset time T, control may be applied. For example, if a pulse value J which is less than the target pulse value is obtained for the preset time T, the pulse value J is input to the function to calculate the flow rate D of supplied water. If an experimenter knows a flow rate of supplied water, a flow rate of water to be supplemented may be predicted. Thus, when the flow rate of water to be supplemented is substituted with the function, the pulse value corresponding thereto may be calculated. Then, the calculated pulse value may be set as a new target pulse value. The flow rates of supplied water and of water to be supplemented may be easily calculated through the following Formula.

$$\text{Flow rate of water to be supplemented}=\text{target flow rate of water}-\text{flow rate of supplied water}$$

As described above, the functional formula is input to the control part to allow the control part to calculate the new target pulse value. Also, the water supply flow rate corresponding to the pulse value, the flow rate of water to be supplemented and the new pulse value corresponding thereto may be tabulated to directly extract the new target pulse value for supplying additional water when the pulse value is detected.

If the detected pulse value does not reach the target pulse value before performing the operation S16, the water supply may be stopped. Then, after the new target pulse value is set, the water supply may start again.

The Table below is an example pulse/flow rate table used in a method for controlling water supply.

The Table below provides a pulse value detected for a preset time (T) in a low water-pressure state, a flow rate of supplied water corresponding to the pulse value, a flow rate to be supplemented, and a new target pulse value corresponding to the flow rate to be supplemented.

For instance, the Table was made from the experiments in a specific low water-pressure state, and the experiments may be performed several times under different water-pressure conditions.

Since the Table is stored in a memory, and then, when the pulse value is detected, the Table is accessed to quickly set an added pulse value corresponding to the corresponding pulse value as a new target pulse value, the water supply may not be stopped in the operation S16. In the case where the functional formula is used, if the processing rate of the control part is sufficiently high, the water supply may not be stopped.

TABLE

| pulse for T sec | flow rate for T sec | flow rate gap(g) | added pulse | supplemented pulse(integer) |
|---|---|---|---|---|
| 71 | 20.2349 | 59.7651 | 209.7031416 | 209 |
| 72 | 20.4329 | 59.5671 | 209.8983111 | 209 |
| 73 | 20.6309 | 59.3691 | 210.0705398 | 210 |
| 74 | 20.8289 | 59.1711 | 210.2204821 | 210 |
| 75 | 21.0269 | 58.9731 | 210.3487675 | 210 |
| 80 | 22.0169 | 57.9831 | 210.6857914 | 210 |
| 85 | 23.0069 | 56.9931 | 210.5635049 | 210 |
| 90 | 23.9969 | 56.0031 | 210.038755 | 210 |
| 95 | 24.9869 | 55.0131 | 209.1593795 | 209 |
| 100 | 25.9769 | 54.0231 | 207.9659236 | 207 |
| 105 | 26.9669 | 53.0331 | 206.4929784 | 206 |
| 110 | 27.9569 | 52.0431 | 204.7702356 | 204 |
| 115 | 28.9469 | 51.0531 | 202.8233248 | 202 |
| 120 | 29.9369 | 50.0631 | 200.6744853 | 200 |
| 125 | 30.9269 | 49.0731 | 198.3431091 | 198 |
| 130 | 31.9169 | 48.0831 | 195.8461818 | 195 |
| 135 | 32.9069 | 47.0931 | 193.1986453 | 193 |
| 140 | 33.8969 | 46.1031 | 190.4136956 | 190 |
| 145 | 34.8869 | 45.1131 | 187.5030312 | 187 |

TABLE-continued

| pulse for T sec | flow rate for T sec | flow rate gap(g) | added pulse | supplemented pulse(integer) |
|---|---|---|---|---|
| 150 | 35.8769 | 44.1231 | 184.4770591 | 184 |
| 155 | 36.8669 | 43.1331 | 181.3450683 | 181 |
| 160 | 37.8569 | 43.1431 | 178.1153766 | 178 |
| 165 | 38.8469 | 41.1531 | 174.7954534 | 174 |
| 170 | 39.8369 | 40.1631 | 171.392026 | 171 |
| 175 | 40.8269 | 39.1731 | 167.9111689 | 167 |
| 180 | 41.8169 | 38.1831 | 164.3583814 | 164 |
| 185 | 42.8069 | 37.1931 | 160.7386543 | 160 |
| 190 | 43.7969 | 36.2031 | 157.0565268 | 157 |
| 195 | 44.7869 | 35.2131 | 153.3161371 | 153 |

According to the refrigerator described in this disclosure, an amount of water to be supplied may be accurately controlled under the low water-pressure state in the water supply system using the flow rate sensor such as the flowmeter.

Particularly, the refrigerator may be advantageous for the ice making system in which an amount of supplied water should be accurately controlled, such as the ice making device for making the globular ice.

Although implementations have been described with reference to a number of illustrative examples thereof, it should be understood that numerous other modifications and implementations can be devised by those skilled in the art that fall within the spirit and scope of the principles of this disclosure. More particularly, variations and modifications are possible in the component parts and/or arrangements and fall within the scope of the disclosure, the drawings and the appended claims. In addition to variations and modifications in the component parts and/or arrangements, alternative uses will also be apparent to those skilled in the art.

What is claimed is:

1. A method comprising:

starting water supply to an ice making device in a refrigerator, the ice making device including a flow sensor configured to detect water supply flow to the ice making device by using a pulse value according to rotation of an impeller;

after starting the water supply, operating the flow sensor to detect a pulse value;

accessing a target pulse value;

comparing the detected pulse value to the target pulse value;

based on comparison results, determining whether the detected pulse value has reached the target pulse value within a preset time; and based on a determination that the detected pulse value has not reached the target pulse value within the preset time, determining that water supply to the ice making device is in a low water-pressure state and performing a water supply control process according to the low water-pressure state, the water supply control process according to the low water-pressure state comprising:

calculating a measurement of water supplied to the ice making device based on the detected pulse value for the preset time;

determining a measurement of additional water needed to reach a target;

setting a new target pulse value corresponding to the measurement of additional water needed to reach the target; and supplying additional water to the ice making device until the new target pulse value has been reached.

2. The method according to claim 1, further comprising stopping water supply to the ice making device based on the detected pulse value reaching the target pulse value within the preset time.

3. The method according to claim 1, wherein the measurement of water supplied to the ice making device, the measurement of additional water, and the new target pulse value are stored in a lookup table.

4. The method according to claim 1, wherein the measurement of water supplied to the ice making device comprises a flow rate of water supplied to the ice making device and the measurement of additional water comprises a flow rate of additional water needed to reach the target.

5. The method according to claim 4, wherein calculating the flow rate of water supplied to the ice making device comprises calculating the flow rate of water supplied to the ice making device using a linear function formula: $y2=Ky1+R$ (K, R: constant, y1: pulse value, y2: flow rate).

6. The method according to claim 1, further comprising, based on a determination that water supply to the ice making device is in a low water-pressure state, stopping water supply to the ice making device until the new target pulse value is set.

7. The method according to claim 1, wherein the ice making device is an ice maker configured to make spherical ice.

8. A refrigerator comprising:

an ice making device;

a flow sensor configured to detect water supply flow to the ice making device by using a pulse value according to rotation of an impeller; and a controller configured to perform operations comprising:

starting water supply to the ice making device;

after starting the water supply, operating the flow sensor to detect a pulse value;

accessing a target pulse value;

comparing the detected pulse value to the target pulse value;

based on comparison results, determining whether the detected pulse value has reached the target pulse value within a preset time; and based on a determination that the detected pulse value has not reached the target pulse value within the preset time, determining that water supply to the ice making device is in a low water-pressure state and performing a water supply control process according to the low water-pressure state, the water supply control process according to the low water-pressure state comprising:

calculating a measurement of water supplied to the ice making device based on the detected pulse value for the preset time;

determining a measurement of additional water needed to reach a target;

setting a new target pulse value corresponding to the measurement of additional water needed to reach the target; and supplying additional water to the ice making device until the new target pulse value has been reached.

9. The refrigerator according to claim 8, wherein the operations further comprise stopping water supply to the ice making device based on the detected pulse value reaching the target pulse value within the preset time.

10. The refrigerator according to claim 8, wherein the measurement of water supplied to the ice making device, the measurement of additional water, and the new target pulse value are stored in a lookup table.

11. The refrigerator according to claim 8, wherein the measurement of water supplied to the ice making device comprises a flow rate of water supplied to the ice making device and the measurement of additional water comprises a flow rate of additional water needed to reach the target.

12. The refrigerator according to claim 11, wherein calculating the flow rate of water supplied to the ice making device comprises calculating the flow rate of water supplied to the ice making device using a linear function formula: $y2=Ky1+R$ (K, R: constant, y1: pulse value, y2: flow rate).

13. The refrigerator according to claim 8, wherein the operations further comprise, based on a determination that water supply to the ice making device is in a low water-pressure state, stopping water supply to the ice making device until the new target pulse value is set.

14. The refrigerator according to claim 8, wherein the ice making device is an ice maker configured to make spherical ice.

15. A method comprising:

starting water supply to an ice making device in a refrigerator, the ice making device including a flow sensor configured to detect water supply flow to the ice making device by using a pulse value according to rotation of an impeller;

after starting the water supply, operating the flow sensor to detect a pulse value;

accessing a target pulse value;

comparing the detected pulse value to the target pulse value;

based on comparison results, determining whether the detected pulse value has reached the target pulse value within a preset time; and in response to a determination that the detected pulse value has not reached the target pulse value within the preset time:

setting a new target pulse value based on the detected pulse value; and supplying additional water to the ice making device until the new target pulse value has been reached.

16. The method according to claim 15, further comprising stopping water supply to the ice making device based on the detected pulse value reaching the target pulse value within the preset time.

17. The method according to claim 15, wherein the new target pulse value is stored in a lookup table.

18. The method according to claim 17, wherein setting the new target pulse value based on the detected pulse value comprises accessing the new target pulse value from the lookup table based on the detected pulse value.

19. The method according to claim 15, further comprising, in response to a determination that the detected pulse value has not reached the target pulse value within the preset time, stopping water supply to the ice making device until the new target pulse value is set.

20. The method according to claim 15, wherein the ice making device is an ice maker configured to make spherical ice.

* * * * *